US005845438A

United States Patent [19]

Haskell

[11] Patent Number: 5,845,438

[45] Date of Patent: Dec. 8, 1998

[54] BUILDING DAMPER APPARATUS

[76] Inventor: Gregg O. Haskell, 17554 Main St., Knights Ferry, Calif. 95361

[21] Appl. No.: 811,387

[22] Filed: Mar. 4, 1997

Related U.S. Application Data

[63] Continuation-in-part of Ser. No. 395,893, May 22, 1995, abandoned.

[51] Int. Cl.[6] ..... E04H 9/02

[52] U.S. Cl. ..... 52/167.1; 52/167.3

[58] Field of Search ..... 52/167.3–167.1

[56] References Cited

U.S. PATENT DOCUMENTS

| | | | |
|---|---|---|---|
| 3,691,712 | 9/1972 | Bowling et al. | 52/167.1 X |
| 4,409,765 | 10/1983 | Pall | 52/167.1 |
| 5,533,307 | 7/1996 | Tsai et al. | 52/167.3 |
| 5,560,162 | 10/1996 | Kemeny | 52/167.3 |

FOREIGN PATENT DOCUMENTS

| | | | |
|---|---|---|---|
| 0101268 | 4/1990 | Japan | 52/167.3 |
| 402261171 | 10/1990 | Japan | 52/167.3 |

*Primary Examiner*—Robert Canfield
*Attorney, Agent, or Firm*—Thomas R. Lampe

[57] ABSTRACT

Brace apparatus for bracing a building or other structure and for applying damping forces to the structure during seismic disturbance includes a slider member slidably mounted on the structure. A brace member is connected to the slider member and is attached to the structure at a location spaced from the slider member. A damper member is connected to the slider member for damping and restricting sliding movement of the slider member relative to the structure. A track is provided to guide sliding movement of the slider member relative to the structure along a predetermined path of movement.

10 Claims, 4 Drawing Sheets

BUILDING DAMPER APPARATUS

This application is a continuation-in-part of U.S. patent application Ser. No. 08/395,893, filed May 22, 1995, now abandoned.

TECHNICAL FIELD

This invention relates to apparatus for bracing a structure and for applying damping forces to the structure during seismic disturbance. More particularly, the invention is applicable to building structures, adding strength to buildings and damping same with minimum disturbance of the building contents.

BACKGROUND OF THE INVENTION

Many approaches have been devised for bracing buildings to enable the buildings to resist the forces applied thereto during earthquakes. Earlier techniques involved rigidly bracing buildings; however, it is now the generally accepted and preferred practice to utilize damping devices of various types for absorbing energy applied to the building during seismic disturbances.

Considered representative of the current state of the prior art in this field are those devices and methods disclosed in the following: U.S. Pat. No. 4,922,667, issued May 8, 1990, U.S. Pat. No. 4,577,826, issued Mar. 25, 1986, U.S. Pat. No. 4,910,929, issued Mar. 27, 1990, U.S. Pat. No. 5,065,552, issued Nov. 19, 1991, Japanese Patent Publication 1-322041, dated Dec. 27, 1989, Japanese Patent Publication 2-101268, dated Apr. 13, 1990, Japanese Patent Publication 53-19655, dated Feb. 23, 1978, Soviet Union Patent Publication No. 808,659, dated Feb. 28, 1981, and British Patent Specification No. 825,059, published Dec. 9, 1959.

Prior art bracing and damping devices for buildings are often characterized by their relative complexity and high cost, both with regard to the device structure itself and to the installation thereof. Installation can be time consuming and difficult. Specialized structural components are often required.

DISCLOSURE OF INVENTION

The present invention relates to brace apparatus which is employed in combination with a building or other structure including spaced columns, an upper beam extending between the spaced columns, and a lower beam extending between the spaced columns.

The brace apparatus is for bracing the structure and for applying damping forces to the structure during seismic disturbance.

The brace apparatus includes a brace member attached to the structure at a first location on the brace member. Slider means is slidably mounted on the structure and connected to the brace member at a second location on the brace member spaced from the first location.

Damper means is operatively connected to the slider means for damping and restricting sliding movement of the slider means relative to the structure. The brace apparatus additionally comprises guide means connected to the structure for guiding sliding movement of the slider means relative to the structure along a predetermined path of movement.

The brace apparatus is characterized by its simplicity and relatively low cost as compared to many prior art arrangements. Furthermore, the brace apparatus is highly effective to strengthen and dampen a building to limit damage thereto from earthquakes. The apparatus lends itself to adoption during construction of a building and also to retrofitting existing structures. Installation is readily and quickly accomplished utilizing standard components.

Other features, advantages, and objects of the present invention will become apparent with reference to the following description and accompanying drawings.

MODES FOR CARRYING OUT THE INVENTION

Figure 1:
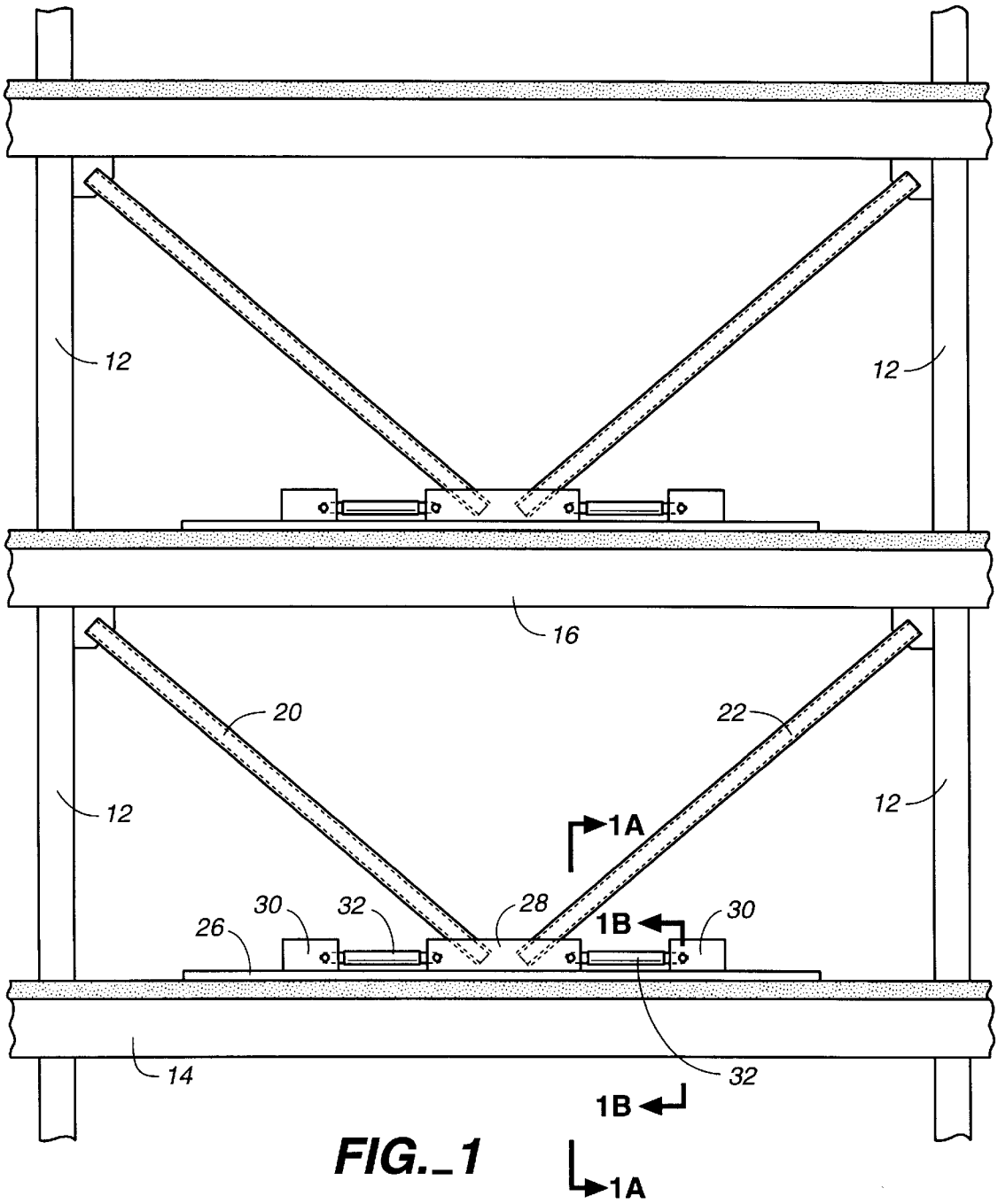
FIG. 1 is a side view of a building structure disclosing two bays, each of which has apparatus constructed in accordance with the teachings of the present invention installed therein.

FIG. 1 illustrates a structure in the form of a partial building frame, two full stories of which are illustrated. More particularly, two levels of bays are shown, each bay being defined by spaced columns 12 and upper and lower beams extending between the spaced columns. With regard to the lower bay, the lower beam is identified by reference numeral 14 and the upper beam by reference numeral 16. In the disclosed arrangement, beam 16 also comprises the lower or floor beam of the upper level or bay.

Disposed in each of the bays is brace apparatus constructed in accordance with the teachings of the present invention. Since the brace apparatus of the embodiment under discussion is identical for both floors or levels, only that located within the lower bay will be described.

The brace apparatus includes two brace members 20, 22. Brace members 20, 22 are what are known in the construction industry as "tubes", being rigid, hollow, elongated structural elements formed of a suitable material such as steel.

The upper ends of brace members 20, 22 are connected to the building structure. The upper ends are attached to the structure at the junctions formed between the columns 12 and upper beam by connector plates at such locations.

Figure 1A:
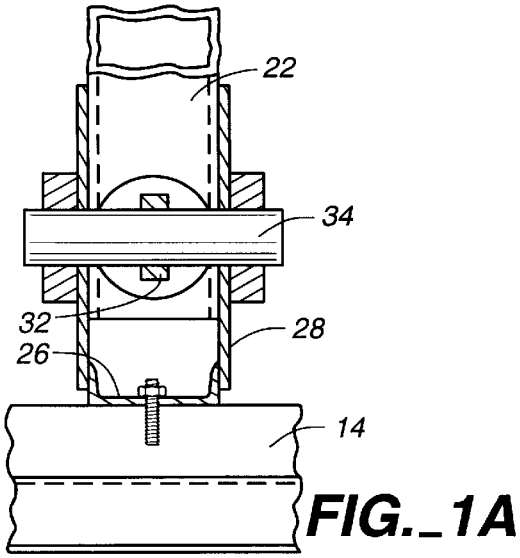
FIG. 1A is an enlarged sectional view taken along the line 1A—1A in FIG. 1.
Figure 1B:
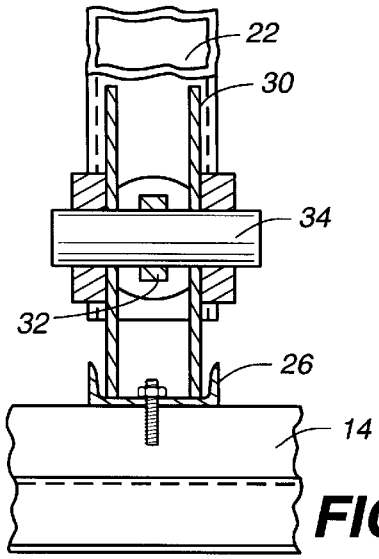
FIG. 1B is an enlarged cross-sectional view taken along the line 1B—1B of FIG. 1.
Figure 2A:
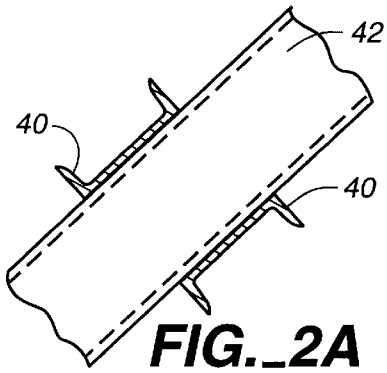
FIG. 2A is an enlarged cross-sectional view taken along the line 2A—2A of FIG. 2.
Figure 4:
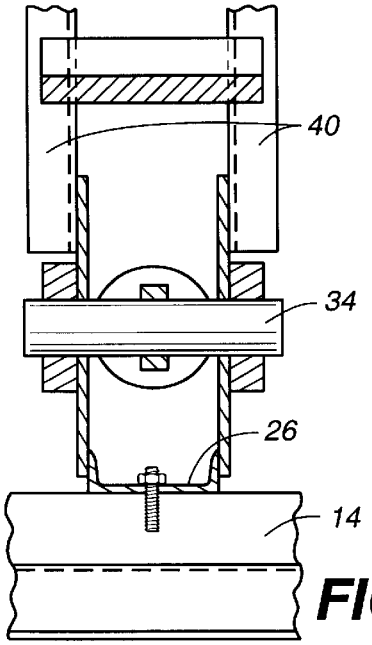
FIG. 4 is an enlarged cross-sectional view taken along the line 4—4 in FIG. 3.
Figure 5:
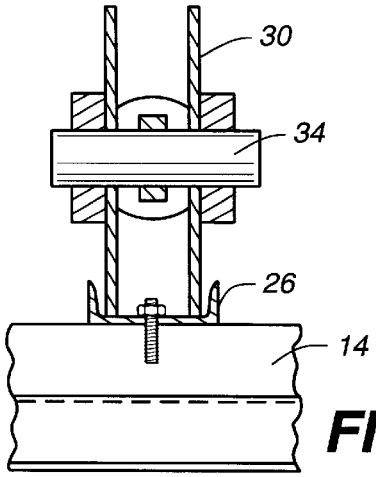
FIG. 5 is an enlarged cross-sectional view taken along the line 5—5 in FIG. 3.
Figure 2:
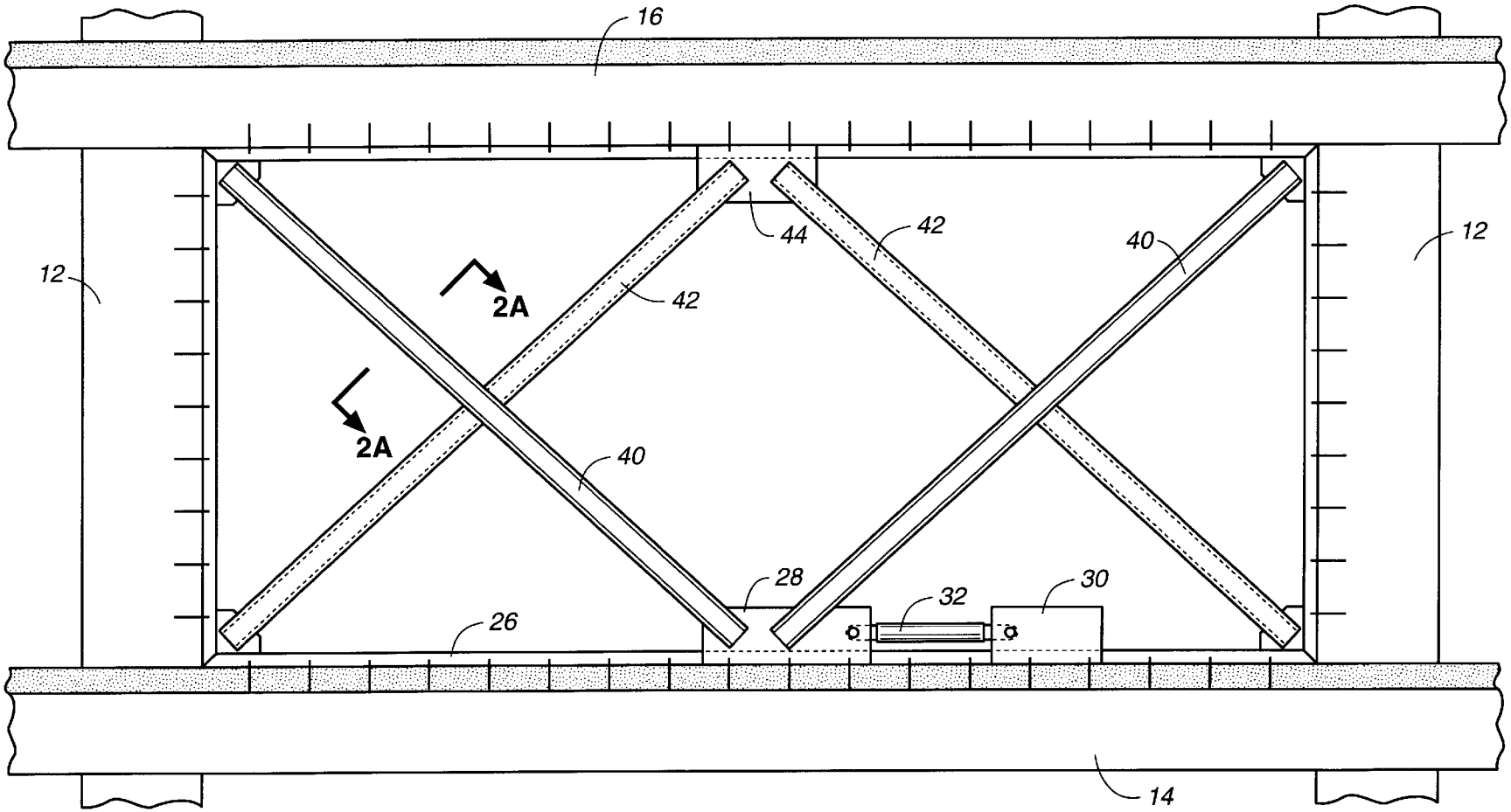
FIG. 2 is a side view of a building structure having an alternate form of apparatus constructed in accordance with the teachings of the present invention installed thereon.
Figure 3:
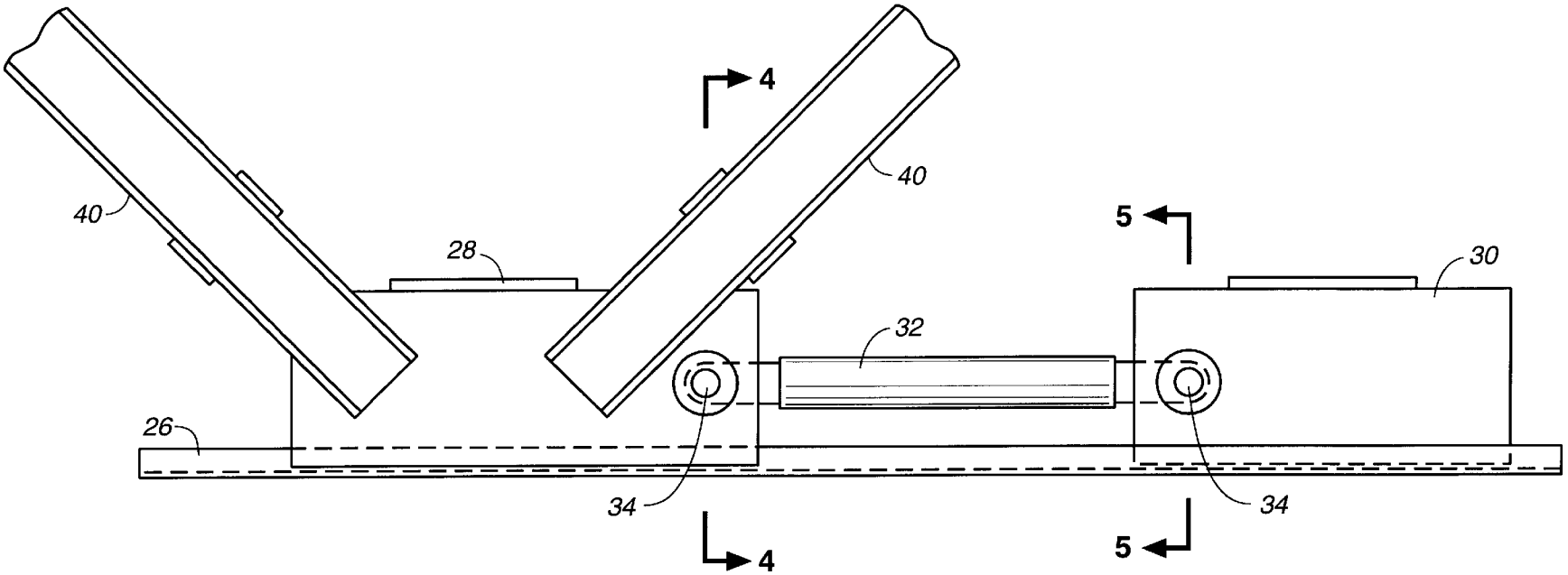
FIG. 3 is an enlarged side view illustrating selected components of the form of apparatus shown in FIG. 2.

Referring now also to FIGS. 1A and 1B, a track 26 in the form of a structural channel member is bolted or otherwise secured to lower beam 14. The track is straight and defines a straight predetermined path of movement for a slider member 28 slidably mounted on the track. The lower ends of brace members 20, 22 are connected to the slider member. The brace members 20, 22 are angularly disposed and diverge away from one another as they proceed upwardly toward the respective junctions defined by columns 12 and upper beam 16.

Spaced from slider member 28 and disposed on opposed sides thereof are anchor members formed of steel or the like which are welded or otherwise affixed to track 26. The anchor members are identified by reference numeral 30.

Interconnecting slider member 28 and anchor members 30 are viscous dampers 32 of any suitable commercially available type. The dampers are for damping and restricting sliding movement of the slider member 28 relative to the building structure during seismic disturbances. The sliders, of course, will be prompted to slidably move relative to the lower beam when forces are applied thereto by the brace members 20, 22 during shaking of the building.

Any suitable means may be employed to connect the viscous dampers 32 to the anchor members and the slider member, an example being link pins 34.

To summarize operation, motion of the upper floor will drive the slider member 28 through the agency of brace members 20, 22. Any movement of the lower floor will cause a corresponding movement of anchor members (deadmen) 30. The differential between these movements actuates the viscous dampers 32 to provide the desired damping forces to the building structure.

Referring now to FIGS. 2–5, an alternative embodiment of the invention is illustrated. In this embodiment there is only a single anchor member 30 and a single viscous damper 32 operatively associated with slider member 28.

In addition, in this arrangement there are two pairs of brace members connected to the slider member and extending to the corner junctions of the structure formed by the columns 12 and the upper beam 16. More particularly, two rigid, elongated channel members or elements 40 extend between the slider member 28 to the upper corners of the bay. Supplementing such arrangement are two additional brace members 42 disposed between the channel elements of each pair thereof. The brace members 42 are hollow "tubes" connected to the building structure at the lower corners or junctions formed by columns 12 and lower beam 14. The upper ends of hollow brace members 42 are attached to the upper beam 16 at a location generally midway between columns 12, any suitable means such as connector plate 44 being employed for such purpose.

It will be appreciated that the arrangements described above are representative of those which may be employed when practicing the teachings of the present invention. Various modifications may be carried out without departing from the spirit or scope of the present invention. For example, the track, slider member and related structure may be attached to the upper beam of a bay rather than the lower beam. Other forms of structural brace members may be employed to interconnect the slider member to the building or other structure. Types of dampers other than viscous dampers, for example visco-elastic dampers or friction dampers, can be employed when practicing the teachings of the invention. The brace apparatus need only be employed in selected bays of a building structure.

It will further be appreciated that the structural components employed can be readily installed on a structure and suitably can comprise standard structural components employed in the building industry. Installation requires no precision fitting as may often be the case with respect to other building damping systems. The system is essentially self-jigging in that the apparatus may be assembled in such a manner as to mount the anchor member or members in position last. This may be accomplished by welding the anchor members or deadmen in position on the beam and track or by employing suitable mechanical fasteners.

I claim:

1. In combination:

a structure including spaced columns, an upper beam having a longitudinal axis extending between said spaced columns, and a lower beam having a longitudinal axis extending between said spaced columns; and brace apparatus for bracing said structure and for applying damping forces to said structure during seismic disturbance, said brace apparatus including a brace member attached to said structure at a first location on said brace member, slider means slidably mounted on said structure and connected to said brace member at a second location on said brace member spaced from said first location, damper means operatively connected to said slider means for damping and restricting sliding movement of said slider means relative to said structure, guide means connected to said structure for guiding sliding movement of said slider means relative to said structure along a predetermined path of movement, said guide means comprising a straight track having a longitudinal axis, said straight track fixedly attached to one of said beams and extending therealong with the longitudinal axis of said straight track oriented in the direction of the longitudinal axis of the beam to which said straight track is fixedly attached, and said predetermined path of movement being straight and oriented in the direction of the longitudinal axis of the beam to which said straight track is fixedly attached, and anchor means fixedly attached to said straight track, said damper means being connected to said anchor means and extending between said slider means and said anchor means adjacent to said straight track.

2. The combination according to claim 1 wherein said brace apparatus includes a plurality of brace members attached to said structure and connected to said slider means.

3. The combination according to claim 1 wherein said damper means comprises at least one viscous damper connected to said slider means.

4. The combination according to claim 1 wherein said brace member comprises a rigid, hollow, elongated structural element secured to said structure at one of said beams.

5. The combination according to claim 1 wherein said damper means comprises a plurality of dampers connected to said slider means.

6. The combination according to claim 1 wherein said structure defines a bay located above said lower beam, below said upper beam, and between said spaced columns, said brace apparatus being positioned within the confines of said bay.

7. The combination according to claim 1 wherein said brace member is attached to said structure at a junction formed between one of said columns and one of said beams.

8. The combination according to claim 7 wherein said slider means is located between said columns and wherein said brace member is angularly disposed relative to said columns and said beams.

9. The combination according to claim 8 wherein said brace member has opposed ends, one of said ends comprising said first location and the other of said ends comprising said second location.

10. Apparatus for bracing a structure including spaced columns, an upper beam having a longitudinal axis extending between said spaced columns, and a lower beam having a longitudinal axis extending between said spaced columns and for applying damping forces to said structure during seismic disturbance, said apparatus including a brace member for attachment to said structure at a first location on said brace member, slider means for slidable mounting on said structure and connected to said brace member at a second location on said brace member spaced from said first location, damper means operatively connected to said slider means for damping and restricting sliding movement of said slider means relative to said structure, guide means for connection to said structure for guiding sliding movement of said slider means relative to said structure along a predetermined path of movement, said guide means comprising a straight track having a longitudinal axis, said straight track for fixed attachment to a beam and for extension therealong with the longitudinal axis of said straight track oriented in the direction of the longitudinal axis of the beam, and said predetermined path of movement being straight and oriented in the direction of the longitudinal axis of the beam, and anchor means fixedly attached to said straight track, said damper means being connected to said anchor means and extending between said slider means and said anchor means adjacent to said straight track.

* * * * *